United States Patent [19]

Uchida et al.

[11] 4,384,620

[45] May 24, 1983

[54] MULTIPURPOSE-TYPE BLADE DEVICE FOR EARTH MOVING MACHINE

[75] Inventors: Tomio Uchida, Ebetsu; Kisaburo Otabe, Isehara, both of Japan

[73] Assignees: Caterpillar Mitsubishi Ltd.; Hokkaido Construction Equipment Sales, Ltd., both of Japan

[21] Appl. No.: 211,817

[22] Filed: Dec. 1, 1980

[30] Foreign Application Priority Data

Jan. 29, 1980 [JP] Japan ..... 55-8269

[51] Int. Cl.[3] ..... E02F 3/76

[52] U.S. Cl. ..... 172/815; 172/701.3; 37/281; 37/275

[58] Field of Search ..... 172/815, 701.1, 701.2, 172/701.3; 37/44, 46, 275, 281

[56] References Cited

U.S. PATENT DOCUMENTS

| | | | |
|---|---|---|---|
| 1,900,703 | 3/1933 | Frink | 37/275 |
| 1,926,011 | 9/1933 | Soule | 37/275 |
| 1,997,001 | 4/1935 | Lamb | 172/815 |
| 2,160,972 | 6/1939 | Litchy | 37/44 |
| 2,428,131 | 9/1947 | Uebelhoer | 172/815 X |
| 2,904,904 | 9/1959 | Krueger | 37/275 |
| 4,135,583 | 1/1979 | Becker | 172/815 |

FOREIGN PATENT DOCUMENTS

| | | | |
|---|---|---|---|
| 44-17956 | 8/1969 | Japan . | |
| 49-37361 | 10/1974 | Japan . | |
| 52-8618 | 3/1977 | Japan . | |
| 371316 | 7/1973 | U.S.S.R. | 172/815 |

*Primary Examiner*—Richard J. Johnson

*Attorney, Agent, or Firm*—Robert E. Burns; Emmanuel J. Lobato; Bruce L. Adams

[57] ABSTRACT

A blade device composed of a support frame mounted on the front end of an earth moving machine, a pair of blade members, whose each inside end is pivotably connected to the center of the front portion of said support frame and a pair of cylinder mechanisms interposed between said pair of blade members and said support frame. On the front surface of said support frame, a protecting plate covering the interconnecting portion of each said pair of blade members and said support frame is fixed.

3 Claims, 6 Drawing Figures

MULTIPURPOSE-TYPE BLADE DEVICE FOR EARTH MOVING MACHINE

FIELD OF INVENTION

This invention relates to a multipurpose-type blade device for an earth moving machine, and more particularly, to a multipurpose-type blade device mounted on the front end of the earth moving machine to be used for various operations such as snow removing operation, etc.

DESCRIPTION OF THE PRIOR ART

As a multipurpose-type blade device mounted on the front end of a wheel-type or a track-type loader or tractor to be used for various operations such as snow removing operation, etc., the multipurpose-type blade device composed of a support frame mounted on the front end of an earth moving machine, a pair of blade members whose each inside end is pivotably connected to the center of the front portion of said support frame and a pair of cylinder mechanisms interposed between said pair of blade members and said support frame has conventionally been devised and put into practice as disclosed in Japanese Utility Mode Publication No. 37361/74, Japanese Utility Model Publication No. 17956/69 and U.S. Pat. No. 4,135,583. The mounting of the inside end of each pair of blade members on the center of the supporting frame is performed in such a way that a plurality of hinge-like connecting arms are protruded alternately of the inside end of each pair of blades, and the connecting arms are pivotably connected to the center of the support frame by means of connecting pins.

However, it became clear that there were below mentioned important problems to be solved in the well known multipurpose-type blade device mentioned above. That is, in the well known multipurpose-type blade device, part of the surface of the aforementioned connecting arms positioned between the surfaces of a pair of blade members as well as the surface of the pair of blade members define the so-called operating surfaces of the blade device, hence, in case snow removing or earth moving operation is to be performed by the blade device, part of the surface of the connecting arms which are pivotably connected to the supporting frame by means of connecting pins are brought into direct abutment with earth and sand. In such a case, earth and sand enter the space, etc. between the connecting arms and the connecting pins, which causes the connecting arms and/or the connecting pins to be worn out in a short period of time.

Also, to effectively perform snow removing or earth moving operation by the blade device, although it is desirable to have the surface positioned between the surfaces of a pair of blade members (in the conventional blade device, the surface to be defined by part of the surfaces of the connecting arms or by part of the surfaces of the connecting arms and part of the surfaces of the supporting frame) curved having curvature corresponding to that of the surface of the blade members. To do so, each surface of a plurality of connecting arms protruded at the inside end of a pair of blade members must be curved as desired. This will result in the manufacture of the connecting arms to be considerably difficult as well as expensive.

SUMMARY OF THE INVENTION

The object of this invention is to provide a novel and excellent multipurpose-type blade device for an earth moving machine without problems as mentioned above which exist in the well known multipurpose-type blade device of an earth moving machine.

Another object of this invention is to provide a novel and excellent multipurpose-type blade device for an earth moving machine which is able to variously change the shape of the operational surface of the blade device relatively easily in conformity with the conditions of operation to be performed in addition to performing the above mentioned main object.

According to this invention, there is provided multipurpose-type blade device for an earth moving machine comprising a supporting frame mounted on the front and of an earth moving machine, a pair of blade members whose each inside end is pivotably connected to the center of the front portion of the support frame and a pair of cylinder mechanisms interposed between each of said pair of blade members and the support frame; being characterized in that a protecting plate covering interconnecting portion of each of said pair of blade members and said support frame is secured to the front surface of said support frame.

In the preferred embodiment of the multipurpose-type blade device for an earth moving machine in accordance with this invention, the surface of the protecting plate is curved to have curvature corresponding to that of the surface of the pair of blade members. Also, each of the pair of blade members is in the shape that its height of the surface is gradually reduced toward the outside end so that the operational surface of the blade device can variously be changed relatively easily in conformity with the type of operation to be performed, and on the upper end portion of each of the pair of blade members, auxiliary blade members are mounted for pivoting between the operational position defining the surface continuously extending upward from the surface of the blade members and the inoperational position turned backward from the operational position.

In addition, a locking mechanism is provided to releasably lock each of the auxiliary blade members in the operational position, and a spring member elastically urging each of the auxiliary blade members to the inoperational position is interposed between each of the blade members and each of the auxiliary blade members. In the support frame, there is provided a stopping member which abuts the abutment member connected to each of the auxiliary blade members and pivots each of the auxiliary blade members to the operational position when the blade members are pivoted backward about the inside end thereof.

The other objects of this invention will be well understood from the below mentioned description.

DETAILED DESCRIPTION OF PREFERRED EMBODIMENTS

Figure 1:
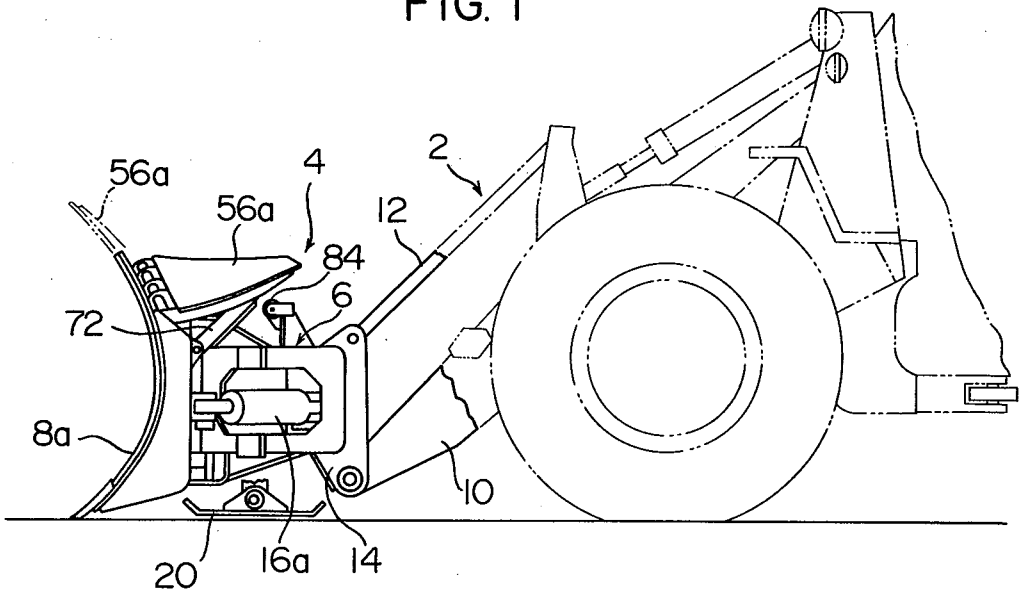
FIG. 1 shows a side view of an embodiment of the blade device mounted on the front end of an earth moving machine in accordance with this invention.

Detailed descriptions of an embodiment of the multipurpose-type blade device for an earth moving machine constructed in accordance with this invention are given below referring to the drawings attached.

Figure 2:
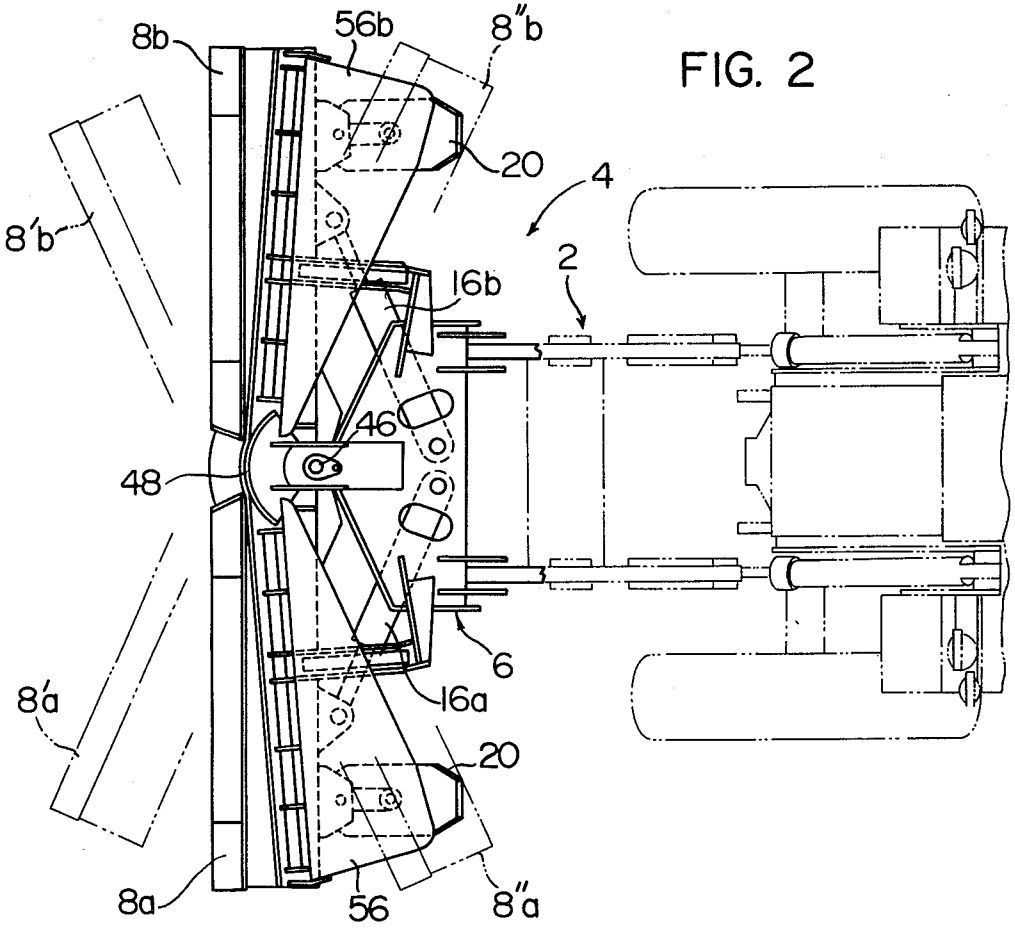
FIG. 2 is a plane view of the blade device shown in FIG. 1.
Figure 3:
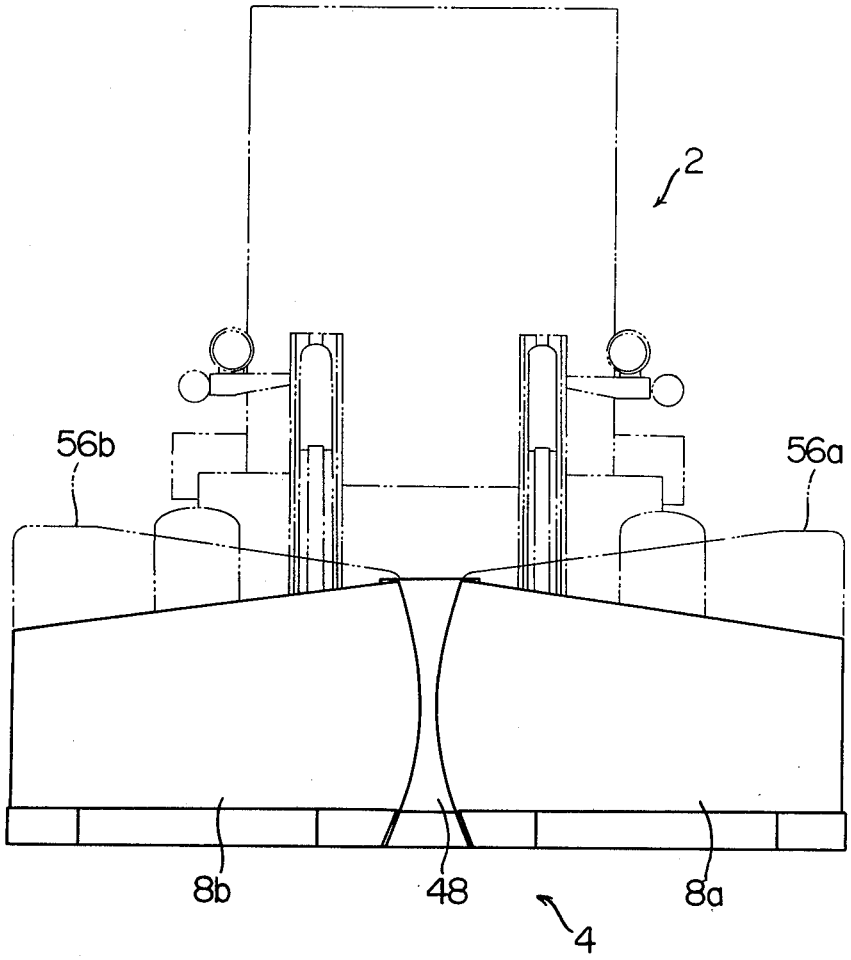
FIG. 3 is a front view of the blade device shown in FIG. 1.

With reference to FIG. 1 to FIG. 3, the blade device generally shown at 4 to be mounted on the front end of an earth moving machine 2 (part of a wheel type loader is shown in FIGS. 1 to 3), like a wheel type or tracktype loader, constructed in accordance with this invention includes a support frame 6, and a pair of blade members 8*a* and 8*b*.

The support frame 6 itself is mounted on the front end of the earth moving machine 2 by a well known method. In the illustrated embodiment, at the tips of a pair of list arms 10 and a pair of tilt links 12 of the earth moving machine 2, a support frame 6 is mounted through a quick coupler 14, which itself is well known.

Each of a pair of blade members 8*a* and 8*b* is pivotably mounted at each inside end thereof on the center of the front part of the support frame 6 (regarding the mounting method, detailed explanations will follow). Between each of a pair of blade members 8*a* and 8*b* and the support frame 6, cylinder mechanisms 16*a* and 16*b* which can be composed of an oil pressure cylinder are interposed. To be more particular, the end of each of the cylinder mechanism 16*a* and 16*b* (side ends of the cylinder shown in the illustration) is pivotally connected to the proper position of the support frame 6, and the other end of each of the cylinder mechanism 16*a* and 16*b* is pivotably connected to the rear side face of each of a pair of blade members 8*a* and 8*b*. As mentioned above, it will become clear that by extending or contracting the cylinder mechanism 16*a* by the action of the proper oil pressure control circuit (not shown), the blade member 8*a* is turned forwardly or backwardly, as shown by two-dot chain line 8'*b* or 8''*b*, about its inside end as a center. On the other hand, when the cylinder mechanism 16*b* is extended or contracted, the blade member 8*b* is turned forwardly or backwardly about its inside end as a center.

In the illustrated embodiment, further, a sled 20 is adapted behind each of a pair of blade members 8*a* and 8*b*. This sled 20 is useful for performing snow removing operation by the earth moving machine 2 equipped with the blades device 4, and by contacting the ground surface from which snow is to be removed, it promotes sliding efficiency of blade device 4.

The composition of the blade device 4 as above composed in accordance with this invention is well known to those who are skilled in the art, and it is not a novel feature of the blade device 4 composed in accordance with this invention. Therefore, detailed description for the composition as mentioned above will be omitted in this specification.

Next, descriptions are given below about the composition of the connecting portion of the inside end of each blade member 8*a* and 8*b* facing the center of the front part of the support frame 6 which constitute a novel and important characteristic of the blade device 4 composed in accordance with this invention, referring to FIGS. 1 to 3 and 4 as well.

Figure 4:
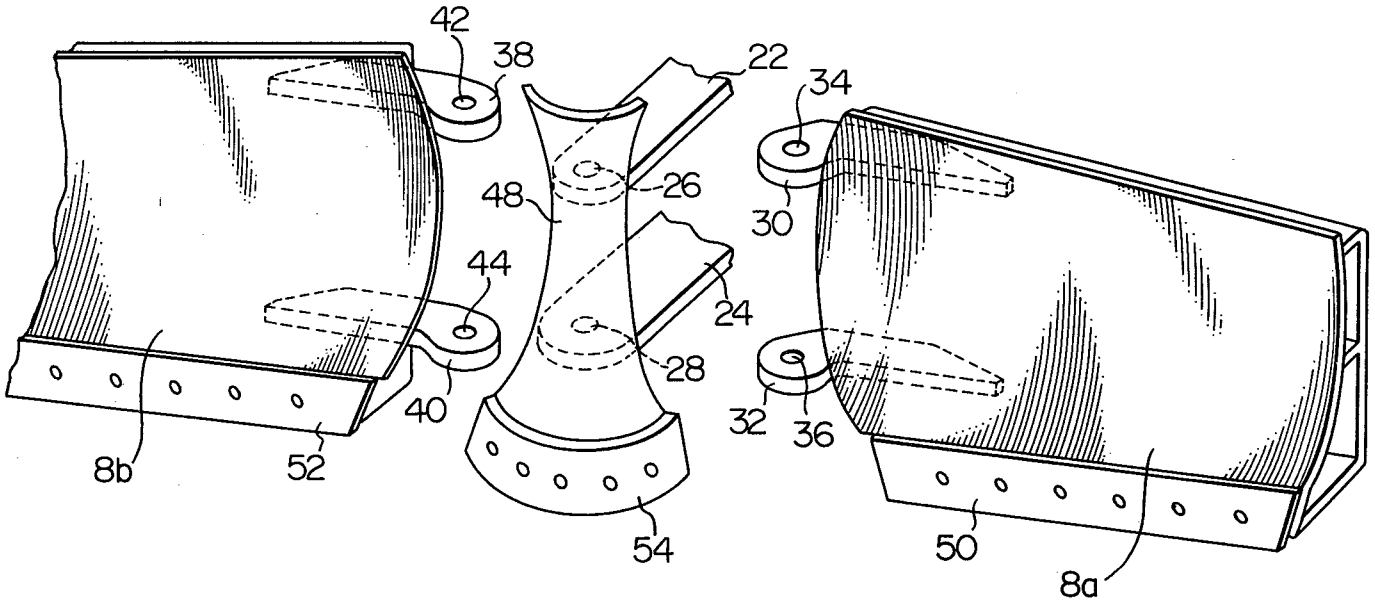
FIG. 4 is an enlarged partial perspective view showing the connecting portion of the inside end of each of a pair of blade members and the center of the front portion of the support frame in the blade device shown in FIG. 1.

Explanations are given mainly referring to FIG. 4. In the illustrated embodiment, on the center of the front portion of the aforementioned support frame 6, there are a pair of plate-like pieces 22 and 24 protruding forwardly at a spaced interval in a perpendicular direction formed in a body or securely connected. On each of the plate-like pieces 22 and 24, holes 26 and 28 which are positioned to match with a perpendicular direction are formed. On the backside surface of the inside end of the blade member 8*a*, a pair of connecting pieces 30 and 32 (a plurality of pairs if necessary to make the connection further securely) are secured in a perpendicular direction at a spaced interval. These connecting pieces 30 and 32 have a portion further protruded toward the inside passing over the inside end of the surface of the blade member 8*a*, and on each such portion, holes 34 and 36 are formed, respectively, matching in the perpendicular direction. In the similar way, a pair of connecting pieces 38 and 40 (if necessary, a plurality of pairs to make the connection further securely) are secured at a spaced interval in the perpendicular direction on the back surface of the inside end of blade member 8*b*. These connecting pieces 38 and 40 have a portion further protruded toward the inside passing over the inside end of the surface of the blade 8*b*, and on each such portion, holes 42 and 44 are formed, respectively, matching in the perpendicular direction.

The mounting of inside ends of blade member 8*a* and 8*b* on the center of the front part of the support frame 6 is performed in the following way. That is, the holes 34 and 36 as well as 42 and 44 formed on the connecting pieces 30 and 32 as well as 38 and 40 of each of the blade members 8*a* and 8*b* are placed to match with the holes 26 and 28 formed on the plate-like pieces 22 and 24 of the support frame 6. Then a shaft 46 is inserted into these holes (Ref. FIG. 2), and by pivotably connecting the connecting pieces 30 and 32 as well as 38 and 40 to the plate-like pieces 22 and 24 the performance is completed. In the illustrated embodiment, the connecting piece 30 is positioned on the upper surface of the plate-like piece 22 and the connecting piece 38 is positioned on the upper surface of the connecting piece 30. Also, the connecting piece 40 is positioned on the under surface of the plate-like piece 24, and the connecting piece 32 is positioned on the under surface of the connecting piece 40.

According to this invention, on the front surface of the above support frame 6, the front ends of a pair of plate-like pieces 22 and 24 in the illustrated embodiment, a protecting plate 48 is fixed by a proper means like welding to cover the inside connecting portion of the inside ends of a pair of blade members 8*a* and 8*b* facing the support frame 6, and the connecting portion of the connecting pieces 30, 32 as well as 38 and 40 facing the plate-like pieces 22 and 24 in the illustrated embodiment.

The surface of this protecting plate 48, as easily understood from FIGS. 2 and 4, with the surface of blade members 8*a* and 8*b* (viz. the surface of mold board), defines, between these surfaces, the operational surface of the blade device 4 (viz. the surface abuts snow or soil or sand in case of snow removing or earth removing operation). Therefore, the surface of the protecting plate 48 is desired to be curved corresponding to the curvature of the surface of the blade members 8*a* and 8*b* so that it can have the same curving shape as that of the blade members 8a and 8b curved in a predetermined shapes clearly illustrated in FIG. 1. In such a case, the flow of snow or soil or sand removed is not hampered by the central portion of the operational surface of the blade device 4 (viz. the portion defined by the surface of the protecting plate 48), hence, snow removing or earth removing operation can be effectively done. Also, at the lower end of the protecting plate 48, it is desirable to have a cutting edge 54 provided to correspond to cutting edges 50 and 52 provided at the lower end of the blade members 8a and 8b.

In the blade device 4 equipped with the protecting plate 48 in accordance with this invention, as aforementioned, the operational surface of the blade device 4 is defined by the surface of a pair of blade members 8a and 8b and the surface of the protecting plate 48, and the interconnecting portion of a pair of blade members 8a and 8b and the support frame 6 is covered by the protecting plate 48. Therefore, when snow removing or earth removing operation is carried out by the blade device 4, entering of soil or sand into the interconnecting portion can completely be prevented.

Contrary to this, in the conventional blade devices disclosed in Japanese Utility Model Publication No. 37361/74, Japanese Utility Model Publication No. 17596/69 and U.S. Pat. No. 4,135,583, the protecting plate as aforementioned is not equipped, and the interconnecting portion of a pair of blade members and the support frame is directly exposed forwardly. Therefore, when snow removing or earth removing operation is done, soil and sand, etc. enter the aforementioned interconnecting portion, whereby each component of the aforementioned interconnecting portion is worn out in a short period of time, or there is a tendency that the pivotal interconnection may be damaged.

Further, in the conventional blade device disclosed in Japanese Utility Model Publication No. 37361/74, Japanese Utility Model Publication No. 17956/69 and U.S. Pat. No. 4,135,583, part of the surface of the interconnecting portion between the surface of a pair of blade members, to be more specifically, part of the side faces of a plurality of connecting pieces (or connecting arms) connected to the inside end of a pair of blade members, defines the operational surface. Accordingly, to make the operational surface defined between the surfaces of a pair of blade members curved in shape the same as that of the surface of the blade members, each side face of the above mentioned plurality of connecting pieces must be made in curved shape, and as this is well appreciated, manufacturing is remarkably difficult and the cost becomes considerably expensive as well.

Different from this, in the blade device 4 equipped with the aforementioned protecting plate 48 in accordance with this invention, just by curving the surface of the protecting plate 48 in a desired shape, manufacturing is easy and inexpensive.

In the blade device 4 illustrated, the below mentioned improvements or modifications are given to the conventional blade devices disclosed in Japanese Utility Model Publication No. 37361/74, Japanese Utility Model Publication No. 17956/69 and U.S. Pat. No. 4,135,583.

That is, as clearly illustrated in FIG. 3, a pair of blade members 8a and 8b are formed in such a way that the height thereof is gradually reduced toward the outside end. Further, on the upper edge portion of each of a pair of blade members 8a and 8b, auxiliary blade members 56a and 56b are pivotably mounted between the operational position shown by a two-dot chain line in FIGS. 1 and 3 and an inoperational position shown by a solid line in FIG. 1. These auxiliary blade members 56a and 56b retreat backwardly against the surface of the blade members 8a and 8b in the inoperational position shown in FIG. 1 by a solid line and have no effect upon snow removing or earth removing operation, but in the operational position shown by a two-dot chain line in FIGS. 1 and 3, they define the surface continuously extending upwardly from the surface of the blade members 8a and 8b, and the surface of the auxiliary blade members 56a and 56b also forms the operational surface of the blade device 4.

The mounting of the blade members 56a and 56b itself as aforementioned is well known, for instance, as disclosed in Japanese Patent Publication No. 8618/77, but in the illustrated embodiment, the auxiliary blade members 56a and 56b are pivoted between the aforementioned operational position and inoperational position, and an independent structure is adopted as a mechanism to maintain them at any one of the operational position or inoperational position. This structure is one and the same for both of the blade members 56a and 56b, so explanations about the auxiliary blade members are given below referring to FIGS. 5 and 6.

Figure 5:
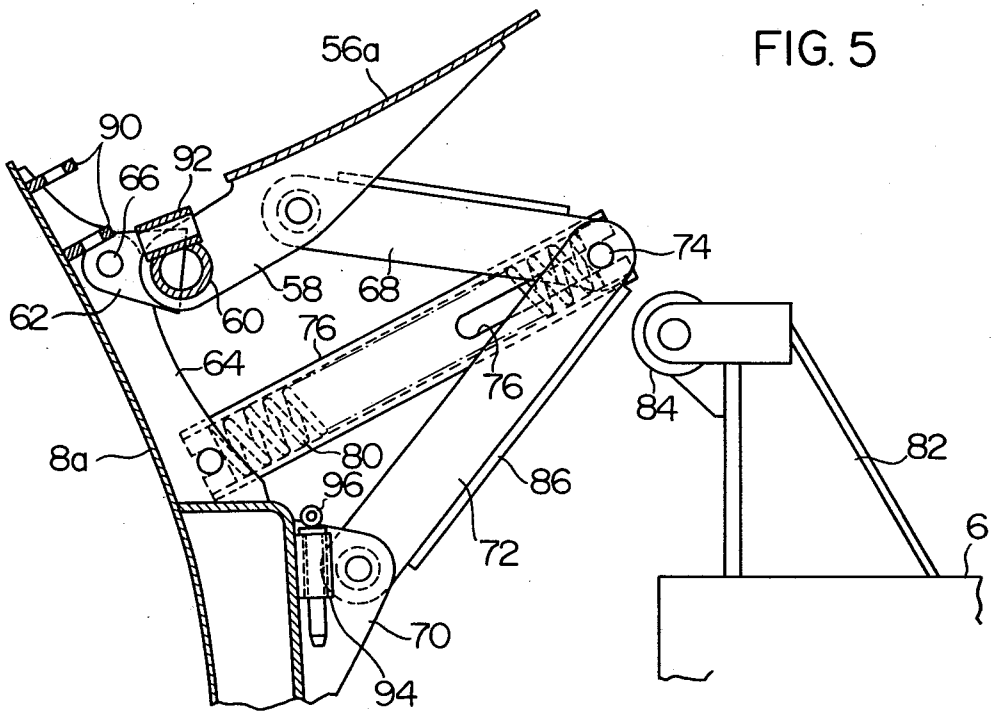
FIGS. 5 and 6 are enlarged sectional views showing the auxiliary blade members and the mechanism relating thereto shown in FIG. 1.

Explaining mainly referring to FIG. 5, a plurality of supporting plates 58 (one of them is shown in FIG. 5) are fixed at space intervals in the lateral direction on the backside surface of the auxiliary blade 56a, and at the lower ends of these supporting plates 58 a tubular member 60 extending in the lateral direction is fixed. On the tubular member 60, a plurality of connecting pieces 62 (one of them is shown in FIG. 5) are fixed in the lateral direction at space interval. Each of these connecting pieces 62 is pivotally connected to each of a plurality of supporting plates 64 (one of which is shown in FIG. 5) secured to the back surface upper edge portion of the blade member 8a by pins 66, thus, the auxiliary blade member 56a is pivotably mounted on the back surface upper edge portion of the blade member 8a about the pin 66. Further, to the illustrated one plate of a plurality of supporting plates 58 secured to the back surface of the auxiliary blade member 56a, one end of a lever 68 is pivotally connected.

On the other hand, a connecting bracket 70 is secured to the back surface of the blade member 8a, and to this connecting bracket 70 one end of a lever 72 is pivotally connected. And the other end of the lever 72 is pivotally connected to the other end of the above mentioned lever 68 by a connecting pin 74. Also, to the illustrated one plate of a plurality of supporting plates 64 secured to the back surface upper edge portion of the blade member 8a, one end of the tubular member 76 is pivotally connected. On the other end of the tubular member 76 a long and slender slot 78 is formed, and in the slot 78, the connecting pin 44 which connects the aforementioned lever 72 and the lever 68 is pivotally and slidably accommodated in the direction of the slot 78 (viz. in the direction of the axis of the tubular member 76). Within the tubular member 76, a spring 80 is provided. One end of this spring 80 abuts the engagement piece 82 formed on one end of the tubular member 68, and the other end abuts the aforementioned connecting pin 74. Thus, the spring 80 elastically urges the aforementioned connecting pin 74 against the tubular member 76 along a slot 78 in FIG. 5.

On the other hand, on the upper surface of the support frame 6, a bracket 82 is fixed, and a roller 84 is rotatably mounted at the tip of the bracket 82. (Ref. to FIG. 1 as well as FIG. 5).

When the blade member 8*a* is in a position shown by a solid line in FIGS. 1 and 2 or in a position shown by a two-dot chain line 8′*a* in FIG. 2, the auxiliary blade member 56*a* is elastically maintained in the inoperational position shown by a solid line in FIG. 5 as well as FIGS. 1 and 2 by the elastic urging action of the spring 80 interposed between the blade member 8*a* and the auxiliary blade member 56*a*, more particularly, between the above mentioned one end of the tubular member 76 and the above mentioned connecting pin 74. However, when the blade member 8*a* is turned backward to the position shown by a two-dot chain line 8″*a* in FIG. 2 by contraction of the cylinder mechanism 16*a*, as well understood referring to FIGS. 5 and 6, the aforementioned roller 84 comprising the stop members abuts the abutment member 86 secured to the lever 72 which is pivoted in the counter-clockwise direction in FIGS. 5 and 6 about its lower end in resistance to the elastic urging action of the spring 80. Thus, the auxiliary blade member 56*a* is pivoted in the operational position shown by a solid line in FIG. 6 and a two-dot chain line in FIGS. 1 and 3 by the action of a link mechanism composed of the lever 72 the lever 68 and the tubular member 76.

Further, on the auxiliary blade 56*a*, a locking mechanism 88 is provided to releasably lock the auxiliary blade member 56*a* and to maintain the auxiliary blade 56*a* in the aforementioned operational position even if the blade member 8*a* is turned forwardly from the position shown by a two-dot chain line 8″*a* in FIG. 2 by extension or contraction of the cylinder mechanism 16*a* (accordingly even if the aforementioned stop member composed of the roller 84 parts from the abutment member 86 secured to the lever 72). In the illustrated embodiment, the locking mechanism 88 comprises a pair of protruding pieces 90 secured to the back surface of the blade member 8*a*, a sleeve 92 secured to the aforementioned tubular member 60 and a lock pins 96 held by a sleeve 94 secured to the back surface of the blade member 8*a*. On the protruding piece 90, there are formed a pair of holes matchable to the through-hole of the sleeve 92 when the auxiliary blade 56*a* is in the operational position. The lock pins 96 are inserted into these holes.

Figure 6:
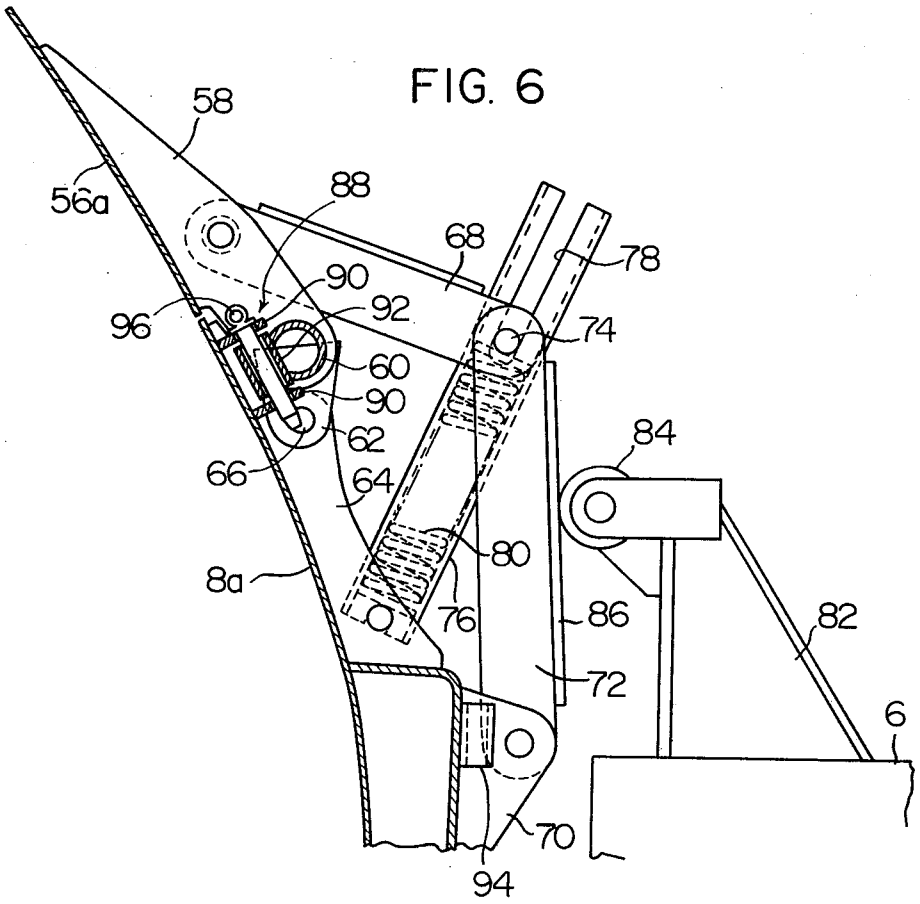

As mentioned above, it will be clearly understood that when lock pins 96 are inserted into the protruding piece 90 and the sleeve 92 the auxiliary blade 56*a* is locked in an operational position as illustrated in FIG. 6. The auxiliary blade 56*a* is securely locked in the operational position regardless of the elastic urging action of the spring 80, on the other hand the locking action is released when the lock pins 96 are detached from the protruding piece 90 and the sleeve 92. As explained above, in the illustrated blade device 4 constructed in accordance with this invention, either one of, or both of, the auxiliary blade members 56*a* and 56*b* are placed in the operational position in accordance with the desire based on the conditions of snow removing or earth removing operation to be performed. Thus, the operation by the blade device can be made a more effective one (as for the operational effects to be brought about by providing the auxiliary blade members 56*a* and 56*b*, as detailed explanations are disclosed in the above mentioned Japanese Patent Publication No. 8618/77, explanations thereof are omitted in this specification.

The detailed explanations have been given above about an embodiment of the blade device constructed in accordance with this invention referring to the accompanying drawing, and there is no need to dwell upon the fact that this invention is not confined to such an embodiment and that various changes or modifications are possible without deviating from the scope of this invention.

What we claim is:

1. A multipurpose-type blade device for an earth moving machine, comprising: a support frame mounted on the front end of the earth moving machine; a pair of blade members each having an inside end pivotably connected to the center of the front part of said support frame, the height of the surface of each of said pair of blade members gradually reducing toward the blade member outside end; a pair of cylinder mechanisms interposed between each of said pair of blade members and said support frame; a pair of auxiliary blade members mounted on the upper edge portion of each of said pair of blade members, respectively; each of said pair of auxiliary blade members being able to pivot between an operational position defining the surface continuously extending upwardly from the surface of each of said pair of blade members and an inoperational position turned backwardly from the operational position; a pair of locking mechanisms for releasably locking each of said auxiliary blade members to said operational position, respectively; a pair of spring members interposed between each of said blade members and each of said auxiliary blade members for elastically urging each of said auxiliary blade members to the inoperational position; a respective abutment member connected on each of said auxiliary blade members; and a pair of stop members on said support frame for abutting said abutment members connected to each of said auxiliary blade members and pivoting each of said auxiliary blade members to said operational position when each of said blade members is pivoted backwardly about the inside end thereof.

2. The multipurpose-type blade device for earth moving machine as set forth in claim 1, further comprising a protecting plate secured to the front surface of said support frame for covering an interconnecting portion of each of said pair of blade members and said support frame.

3. The multipurpose-type blade device for earth moving machine as set forth in claim 2, wherein the surface of said protecting plate is curved having a curvature corresponding to the curvature of the surfaces of said pair of blade members.

* * * * *